US005823326A

United States Patent [19]

Saito et al.

[11] Patent Number: 5,823,326

[45] Date of Patent: Oct. 20, 1998

[54] PUSH LOCK SWITCH

[75] Inventors: Takehiko Saito; Kazue Ohtaki, both of Tokyo, Japan

[73] Assignee: Niles Parts Co., Ltd., Japan

[21] Appl. No.: 864,383

[22] Filed: May 28, 1997

[30] Foreign Application Priority Data

May 29, 1996 [JP] Japan ..... 8-156391

[51] Int. Cl.[6] ..... H01H 3/42

[52] U.S. Cl. ..... 200/524; 200/523; 200/314

[58] Field of Search ..... 200/524, 523, 200/309, 308, 529, 530, 531, 520, 303, 310, 313, 314

[56] References Cited

U.S. PATENT DOCUMENTS

| | | | |
|---|---|---|---|
| 4,636,601 | 1/1987 | Tanabe | 200/524 |
| 4,668,847 | 5/1987 | Greene | 200/524 |
| 4,843,192 | 6/1989 | Kamada et al. | 200/524 |
| 5,605,225 | 2/1997 | Schaeffer | 200/309 |

FOREIGN PATENT DOCUMENTS 64-40134 3/1989 Japan .

*Primary Examiner*—David J. Walczak
*Attorney, Agent, or Firm*—Rader, Fishman, & Grauer

[57] ABSTRACT

A push lock switch having a lock mechanism for use as a hazard switch or a rear defogger switch on an instrument panel of an automobile. The switch has first and second stationary members assembled together which define a space into which a movable member is slidably fitted. A push button fits over the movable member. A coil spring is mounted between the movable member and the first stationary member. The coil spring has first and second compression parts in a one piece construction with each other and urges the movable member toward the push button. A movable contacting strap is fixed to the movable member. The movable contacting member includes movable contacts and a retainer. The movable contacts slide into or out of contact with fixed contacts on the second stationary member when the movable member is pushed by the push button. The first stationary member has a bottom wall in which a recess is formed and on which a plurality of ribs are formed on the recess. A pin rises from the bottom wall of the recess to engage the engagement groove in a heart cam so as to pivotally support the heart cam. The heart cam is formed with a cam groove of a predetermined shape which is engaged with a lock pin inserted into the movable member, thereby providing a push lock mechanism.

3 Claims, 5 Drawing Sheets

PUSH LOCK SWITCH

BACKGROUND OF THE INVENTION

1. Field of the Invention

The present invention relates generally to automotive switches and, in particular, to a push-lock switch usable as a hazard switch or a rear defogger switch and mounted on, for example, an instrument panel of an automobile.

2. Description of the Prior Art

A conventional push lock switch is disclosed, for example, in Japanese Utility Model Preliminary Publication No. 64-40134. This conventional switch is provided with a lock mechanism including a movable member which slides in a stationary member, such as a case. The movable member is formed with a heart-shaped cam groove therein and has a hook-like lock pin mounted thereto. The hook-like pin engages the heart-shaped groove into locking engagement. The movable member moves into engagement with the case and stays where it is depressed when the movable member is pushed in, and moves out of engagement with the case to its original position when it is pushed again.

With the aforementioned construction, the movable member must move vertically and horizontally along the heart-shaped cam groove when the movable member is depressed, so that the free end portion of the lock pin traces the cam groove. The movable member merely engages the lock pin projecting from the case and, therefore, the movement of the movable member is not smooth, thereby failing to ensure reliable locking operation of the mechanism.

SUMMARY OF THE INVENTION

The present invention was made in view of the aforementioned drawbacks.

An object of the invention is to provide a locking mechanism for a push-lock switch which provides reliable locking and unlocking operations.

According to the present invention, a push lock switch is provided having a heart cam 12 pivotally fitted to a stationary member and engaged with a movable member via a lock pin urged to the heart cam. The movable member is adapted to extend from and retract into the space defined by first and second stationary members. Thus, the lock pin only needs to move vertically when the movable member is pushed. This construction ensures that the lock pin engages the heart cam, thereby ensuring stable locking operation.

According to another aspect of the present invention, ribs are formed on at least one of the heart cam and the stationary member. The ribs extend in the direction of pivotal movement of the heart cam and lie in the plane in which the heart cam opposes the stationary member. The ribs provide a sufficiently flat sliding surface, thereby decreasing friction when the heart cam slides. This facilitates smooth pivotal movement of the heart cam while also maintaining its correct position, thereby ensuring stable locking operation.

According to another aspect of the present invention, the movable member has a movable contacting strip mounted thereon, which is formed with movable contacts and a retainer for retaining the lock pin. The movable contacts and retainer are in a one piece construction. This construction eliminates the requirement of a separate member for urging the lock pin against the heart cam, thereby improving manufacturing efficiency.

According to another aspect of the present invention, the urging means for urging the movable member is of a one piece construction which includes the first compression part in the form of a closely wound coil spring and a second compression part in the form of a loosely wound coil spring. With this construction, the first compression part is fully compressed in the first stage of operation where the movable member is depressed a predetermined distance. Upon further depressing, the operation subsequently enters the second stage where the spring constant of the coil spring becomes larger, thereby requiring a larger force to depress the movable member fully into the locking position. In this manner, the construction prevents an impact which would be added to the movable member when the movable member and push button are fully depressed to abut the stationary member. In other words, the larger spring constant in the second stage provides a cushion effect to the switch operation.

According to another aspect of the present invention, the movable member is of a multiple layer construction. Each layer is insert-molded from a resin with a conductive plate therein. At least one of the layers further has caulking straps in a one piece construction with the conductive plate. All the layers are assembled together by caulking. The conductive plates in the layers are individually insert-molded from a resin, the thickness of each layer being substantially the same. This prevents sink marks in the molded resin and improves the operating feeling of the switch. The conductive plate is cut apart at a portion exposed to the holes, and the holes are closed by the adjacent layers upon assembling the multiple layers one over the other, thereby preventing any foreign matters from entering the case. The conductive plate is in a one piece construction with the caulking straps. This eliminates separate parts and allows the assembly of multiple layers by caulking.

According yet another aspect of the present invention, the push button for operating the switch is mounted to the movable member. The push button is formed with a recess in its top surface which receives the name plate. The groove is formed at the periphery of the recess so as to accommodate share droops which are developed at the periphery of the name plate. This eliminates the problem that the share droops may push up the name plate to reduce adhesion and light leaks from the periphery of the name plate.

Further scope of applicability of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention. In the drawings.

DETAILED DESCRIPTION OF THE INVENTION

Figure 1:
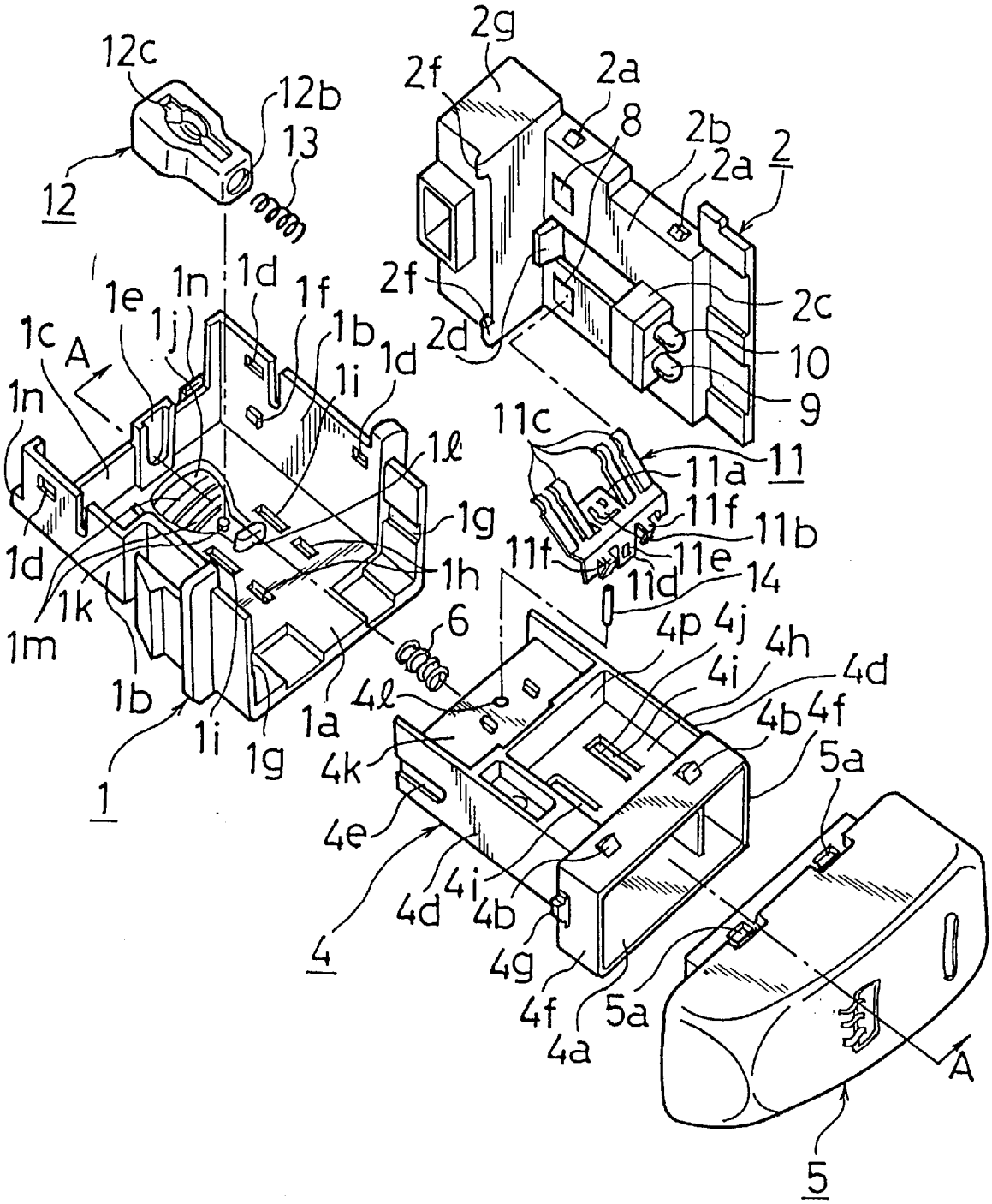
FIG. 1 is an exploded perspective view of a first embodiment of the present invention.
Figure 2:
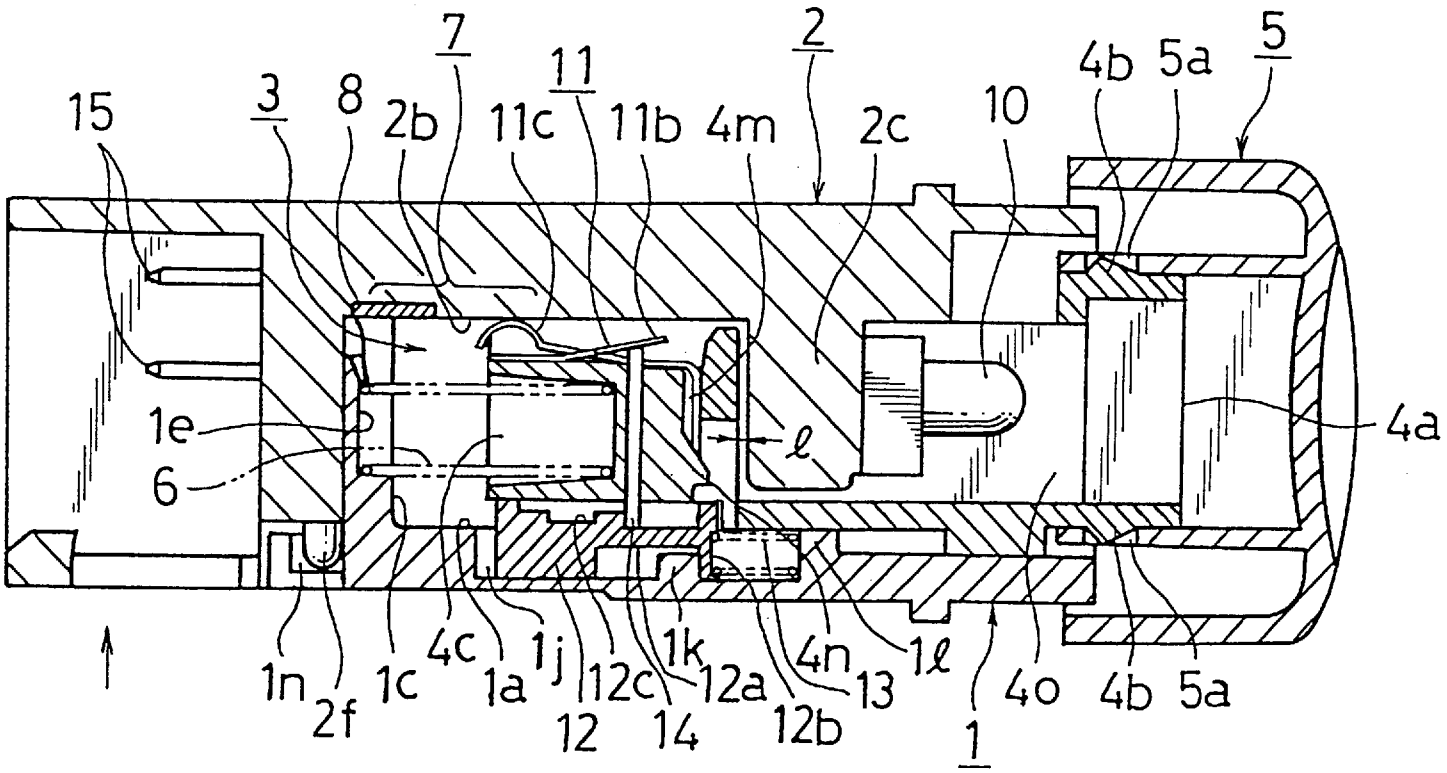
FIG. 2 is a cross-sectional view taken along the line A—A of FIG. 1.

A first embodiment of the invention will now be described in detail with reference to FIGS. 1 to 5 of the drawings. FIG. 1 is an exploded perspective view of the first embodiment, while FIG. 2 is a cross-sectional view taken along the line A—A of FIG. 1.

Referring to FIG. 1, a case serves as a first stationary member 1. The first stationary member 1 is of a generally channel-like shape defined by a bottom wall 1*a* and opposing side walls 1*b* and 1*b* so that the first stationary member 1 has a generally U-shaped cross section. An end wall 1*c* connects the opposed side walls 1*b* and 1*b* and the bottom wall 1*a* at the longitudinal end of the first stationary member 1. Each of the side walls 1*b*, 1*b* is formed with two fastening holes 1*d* and 1*d* into which two fastening projections 2*a* on each side of a second stationary member 2 are fitted when the first and second stationary members are assembled together. Defined between the first and second stationary members 1, 2 is a space 3 (see FIG. 2).

The movable member 4 is inserted into the space 3. The movable member 4 is formed with a generally box-shaped head 4*a* at its one end in a one piece construction therewith. The head 4*a* extends outwardly of the space 3 or retracts into the space 3 as the movable member 4 moves in the space 3. The head 4*a* is provided with fastening projections 4*b* on its upper and lower wall surfaces which engage fastening holes 5*a* formed in a push button 5 when the push button 5 is fitted onto the head 4*a*. The movable member 4 has a hole 4*c* at an end remote from the head 4*a*. The end wall 1*c* of the first stationary member 1 has a seat 1*e*. A coil spring 6 is received at its one end in the hole 4*c* and at the other end in the seat 1*e*. The movable member 4 is urged by the coil spring 6 in a direction so as to project outwardly of the first stationary member 1. A support piece 2*d* projects from the second stationary member 2 and supports the coil spring 6.

The movable member 4 has two opposed side walls 4*d* that oppose the side walls 1*b* of the first stationary member 1. Each side wall 4*d* is formed with an engagement groove 4*e* in an outer surface thereof. The engagement groove 4*e* extends longitudinally of the side wall and opens to the longitudinal end of the side wall 4*d*. The head 4*a* of the movable member 4 has two opposed side walls 4*f* each of which has an engagement projection 4*g* formed thereon.

The side wall 1*b* of the first stationary member 1 is formed with a positioning projection 1*f* on its inner surface near the end wall 1*c*, and a positioning groove 1*g* at the opening end remote from the end wall 1*c*. The positioning groove 1*g* extends in the direction in which the movable member 4 moves in the space 3, and opens to the opening through which the movable member 4 is inserted into the space 3. When the movable member 4 is inserted into the space 3, the positioning projection 1*f* slides in the engagement groove 4*e* and the positioning projection 4*g* slides in the positioning groove 1*g*, thereby guiding the movable member 4 to retract into or extend from the first stationary member 1.

The movable member 4 has a bottom wall 4*h* that opposes the bottom wall 1*a* of the first stationary member 1. The bottom wall 4*h* has two U-shaped holes each of which defines a resilient projecting strip 4*i* extending in the direction in which the movable member 4 moves in the space 3.

Figure 4:
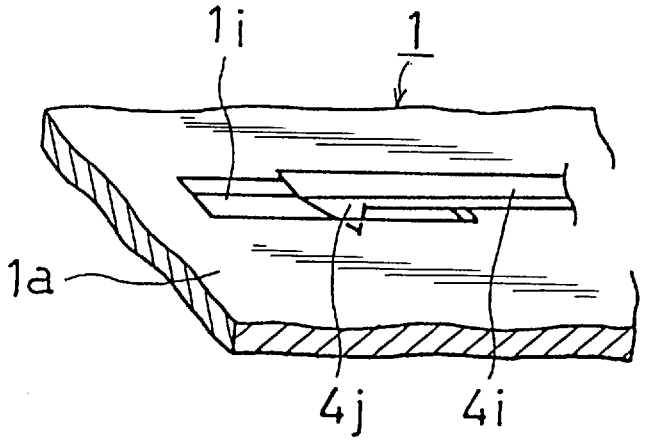
FIG. 4 is a perspective view showing a relevant portion of the first embodiment.

FIG. 4 is a perspective view showing a relevant portion of the first embodiment. The strip 4*i* has a hook 4*j* formed on its free end portion. The hook 4*j* is urged by the resilient force of the positioning strip 4*i* against the bottom wall 1*a*. The hook 4*j* is of a wedge shape generally projecting laterally downwardly of the strip 4*i*. The wedge-shaped hook 4*j* has a surface extending transversely of the strip 4*i* and another surface extending toward the free end of the strip at an angle with the strip 4*i*.

The bottom wall 1*a* of the first stationary member 1 is formed with two pairs of long grooves therein, each pair including a first long groove 1*h* and a second long groove 1*i* therein. The first and second long grooves 1*i* and 1*h* are aligned with each other and extend in the direction in which the movable member moves relative to the first stationary member 1. The first long groove 1*h* is located on the opening side through which the movable member 4 is inserted into the space 3, while the second long groove 1*i* is located on the end wall side. The lengths of the positioning groove 1*g*, the second long groove 1*i*, and the engagement groove 4*e* are such that the movable member 4 can slide in the space 3 to ensure the operation of a switch 7, as described below.

The movable member 4 is formed with a through-hole 4*m* at a location behind a lamp support 2*c* of the second stationary member 2. The through-hole 4*m* extends vertically through the movable member 4. Projecting into the through-hole 4*m* is a fastening hook 4*n* for fastening a movable contacting strip 11, as described below. A pin hole 4*e* is formed between the through-hole 4*m* and the hole 4*c*. A lock pin 14 is inserted into the pin hole 41.

The second stationary member 2 has fixed contacts 8 embedded in its inner wall surface 2*b* that opposes the movable member 4. Also formed on the inner wall surface 2*b* is the lamp support 2*c* that holds a switch-operation indicating lamp 9 and a night lamp 10 therein. Light emitted from the respective lamps 9 and 10 transmit through the push button 5. The fixed contacts 8 are electrically connected with terminals 15 mounted to one end of the second stationary member 2. Projections 2*f* are formed on a connector section 2*g* of the second stationary member 2. When an external force is exerted on the connector section 2*g* in a direction shown by the arrow in FIG. 2, the projections 2*f* transmit the force to the first stationary member 1, thereby preventing the connector section from being damaged.

The movable contacting strip 11 is a resilient and electrically conductive plate-like member and is bent between a first tongue 11*a* and a second tongue 11*d* into a generally L-shape. The first tongue 11*a* extends between the movable contacts 11*c*, and extends along the upper surface 4*k* of the movable member 4 upon assembly. The first tongue 11*a* is formed with a retainer 11*b* that extends from the free end to the base of the first tongue 11*a*. The retainer 11*b* resiliently abuts the lock pin 14 to hold the lock pin in position. The second tongue 11*d* is formed with a fastening hole 11*e* and extends into the through-hole 4*m*. The fastening hole 11*e* engages the fastening hook 4*n*. Formed on both sides of the second tongue 11*d* are resilient arms 11*f* that urge the second tongue 11*d* against the fastening hook 4*n*.

The aforementioned construction ensures that the upward force exerted by the lock pin 14 is resiliently received. A switch 7 includes the fixed contacts 8 provided on the second stationary member 2 and the movable contacts 11 fixed on the movable member 4.

Figure 3:
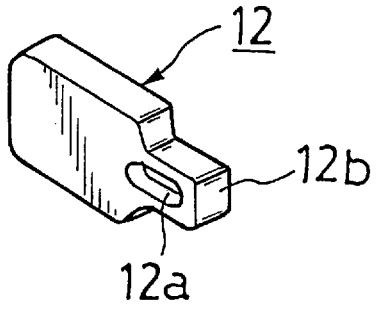
FIG. 3 is a perspective view of a heart cam of the first embodiment.

The bottom wall 1*a* of the first stationary member 1 is formed with a recess 1*j* therein. The recess 1*j* is formed with a pin 1*k* upwardly projecting from its bottom wall at one end of the recess 1*j* and two ribs 1*m* extending arcuately about the pin 1*k*. The pin 1*k* loosely fits into a longitudinally extending engagement groove 12*a* extending in the bottom surface of a heart cam 12 as shown in FIG. 3, thereby holding the heart cam 12 so that the heart cam 12 is pivotally movable and slidable in the direction of movement of the movable member 4 within the recess 1*j*. A coil spring 13 is interposed between the spring seat 1*j* projecting from the bottom wall 1*a* of the first stationary member 1 and a recess formed in a pivoting side 12*b* of the heart cam 12 so as to urge the heart cam 12 toward the end wall 1*c*.

The heart cam 12 is formed with a cam groove 12*c* of a predetermined shape in its surface opposing the movable member 4, and engages the movable member 1 via the lock pin 14 inserted into the pin hole 4*l* extending through the movable member 1, thereby forming a push lock mechanism. The lock pin 14 is urged by the retainer 11*b* of the movable contacting strip 11 toward the heart cam 12.

Figure 5:
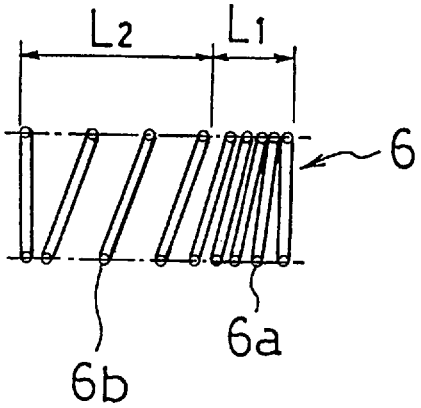
FIG. 5 is a front view of a coil spring used in the first embodiment.

FIG. 5 is a front view of a coil spring 6. Referring to FIG. 5, the coil spring 6 includes a closely wound first compression part 6*a* and a loosely wound second compression part 6*b*. The first and second compression parts 6*a* and 6*b* are of the same coil diameter and wire diameter and are in a one piece construction. The first compression part 6*a* has a length of $L_1$ and number of effective turns of $N_1$, while the second compression part 6*b* has a length of $L_2$ and number of effective turns of $N_2$. Thus, the spring constants a and b of the first and second compression parts 6*a* and 6*b* are proportional to the number of turns $N_1$ and $N_2$, respectively. Thus, the overall spring constant d of the coil spring 6 is $1/d=1/a+1/b$, where $d<a$ and $d<b$, in a first stage where a force exerted on the coil spring is increased until the first compression part 6*a* is fully compressed. The overall spring constant d=b in a second compression stage following the first compression stage, so that the spring constant of the coil spring 6 becomes large when the coil spring 6 shifts from the first compression stage to the second compression stage.

Next, the assembly procedure of the switch according to the present invention will be described. In the first assembly stage, as shown in FIG. 1, the first stationary member 1 is positioned with its opening oriented upward, and the heart cam 12 is placed on the first stationary member 1 with its engagement groove 12*a* fitted to the pin 1*k*. The coil spring 13 is mounted between the spring seat 11 and the side surface 12*b* of the heart cam 12. The coil spring 6 is inserted into the hole 4*c* in the movable member 4.

Then, the movable member 4 is lowered from above with the hooks 4*j* in alignment with the first groove 1*h* until the movable member 4 abuts the bottom wall 1*a*. With this position of the movable member 4 relative to the first stationary member 1, the positioning projection if and the positioning groove 1*g* are not engaged with the engagement groove 4*e* and engagement projection 4*g*, respectively.

Then, the movable member 4 is pushed into the first stationary member 1 toward the end wall 1*c*, during which the hook 4*j* moves out of engagement with the first long groove 1*h* and then into engagement with the second long groove 1*i*. The coil spring 6 received between the movable member 4 and the seat 1*e* urges the movable member 4 toward the head 4*a*. With this position of the movable member 4 with respect to the first stationary member 1, the positioning projection 1*f* and positioning groove 1*g* are in engagement with the engagement groove 4*e* and engagement projection 4*g*, respectively. Therefore, the movable member 4 is prevented from moving out of engagement with the first stationary member 1 in the upward direction or in the direction of movement of the movable member 4.

This intermediate assembly retains its assembled condition without human attendance or retaining jigs.

In the second assembly stage, the lock pin 14 is inserted into the pin hole 4*l*, and the movable contacting strip 11 is assembled with its tongue 11*d* and resilient arms 11*f* inserted into the through-hole 4*m* in the movable member 4 so that the engagement hole 11*e* in the second tongue 11*d* engages the engagement hook 4*n*. Then, the second stationary member 2 is placed on the first stationary member 1 and then pressed onto the first stationary member 1 so that the engagement projections 2*a* fit into the engagement holes 1*d*. Thereafter, the push button 5 is fitted over the movable member 4 with the engagement projections 4*b* engaging the engaging holes 5*a* in the push button 5. This completes the assembly of the switch mechanism.

The operation of the switch mechanism will now be described. With the movable member 4 in the position shown in FIG. 2, the movable contacts 11*c* are out of contact engagement with the fixed contacts 8, thereby holding the switch 7 in the OFF position.

With this condition, pushing the push button 5 causes the movable member 4 to slide against the biasing force of the coil spring 6 so that the movable contacts 11*c* move into contact engagement with the fixed contacts 8, thereby shifting the switch 7 to the ON position. In this first stage of operation, pushing the push button 5 a predetermined distance causes the first compression part 6*a* of the coil spring 6 to be fully compressed. Further pushing the push button 5 causes the operation to enter its second stage where the spring constant of the coil spring 6 becomes larger so that the coil spring 6 pushes back the push button 5 with a larger force. This larger force exerted on the push button 5 prevents the push button 5 from impacting the movable member 4 and first stationary member 1. The lock pin 14 moves into engagement with the cam groove 12*c* and remains engaged so that the heart cam 12 is driven by the lock pin 14 to pivot about the pin 1*k*.

Pushing the push button again causes the lock pin 14 to move out of engagement with the cam groove 12*c*, and the push button returns to the position shown in FIG. 2 due to the biasing force of the coil spring 6, the switch 7 thereby shifting to its OFF position again.

With this type of switch mechanism, the user may mistakenly operate the push button 5 to forcibly pull the push button 5 after the movable member 4 has been pushed into engagement with the lock pin 14 and cam groove 12*c*. If the push button 5 is forcibly pulled, the movable member 4 moves with the push button 5, thereby causing the lock pin 14 to move the heart cam 12 toward the push button 5 against the biasing force of the coil spring 13. The movable member 4 is formed with a recess 4*o* into which the lamp support 2*c* is fitted. The movement of the movable member 4 is limited within a short distance l due to the fact that the wall surface 4*p* of the recess 4*o* abuts the lamp support 2*c*. In other words, the lamp support 2*c* serves as a stopper. The engagement groove 12*e* in the heart cam 12 is selected to be longer than the movement distance of the movable member 4. Therefore, an abnormal load or force will not act between the lock pin 14 and the heart cam 12.

The switch 7 is not limited to a slide switch and may instead be in the form of a touch contact type switch. The heart cam 12 is not limited to the construction in which the pin 1*k* of the first stationary member 1 fits to the engagement hole 12*a*, and may instead be of any other construction as long as the heart cam can move in the movement direction of the movable member 4, i.e., movable relative to the first and second stationary members 1 and 2. For example, the pin 1*k* and engagement groove 12*a* may be interchanged between the first stationary member 1 and the heart cam 12. The first stationary member 1 may be formed with a long groove so that the entire heart cam 12 is fitted movably.

If the heart cam 12 only needs to pivot and need not move in a direction in which the movable member 4 extends, the engagement groove 12*a* can be replaced by a single hole. The two ribs 1*m* formed on the bottom of the recess 1*j* of the first stationary member 1 may be provided on the heart cam 12. The coil spring only needs to urge the operating member (i.e., the push button 5 and movable member 4) in a direction in which the operating member projects outwardly of the first stationary member 1. Therefore, the coil spring 6 may be mounted between the push button 5 and the second stationary member 2.

Figure 6:
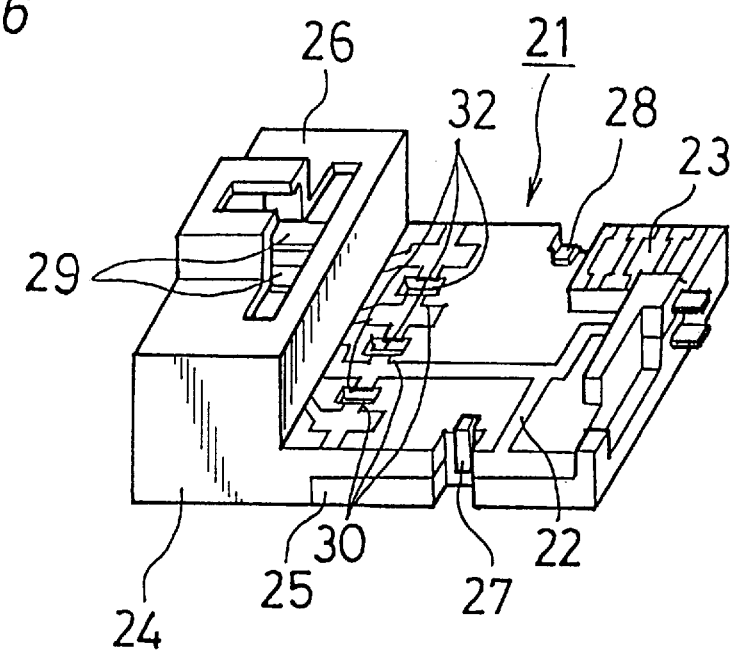
FIG. 6 is a perspective view showing a second stationary member of a second embodiment of the present invention.
Figure 7:
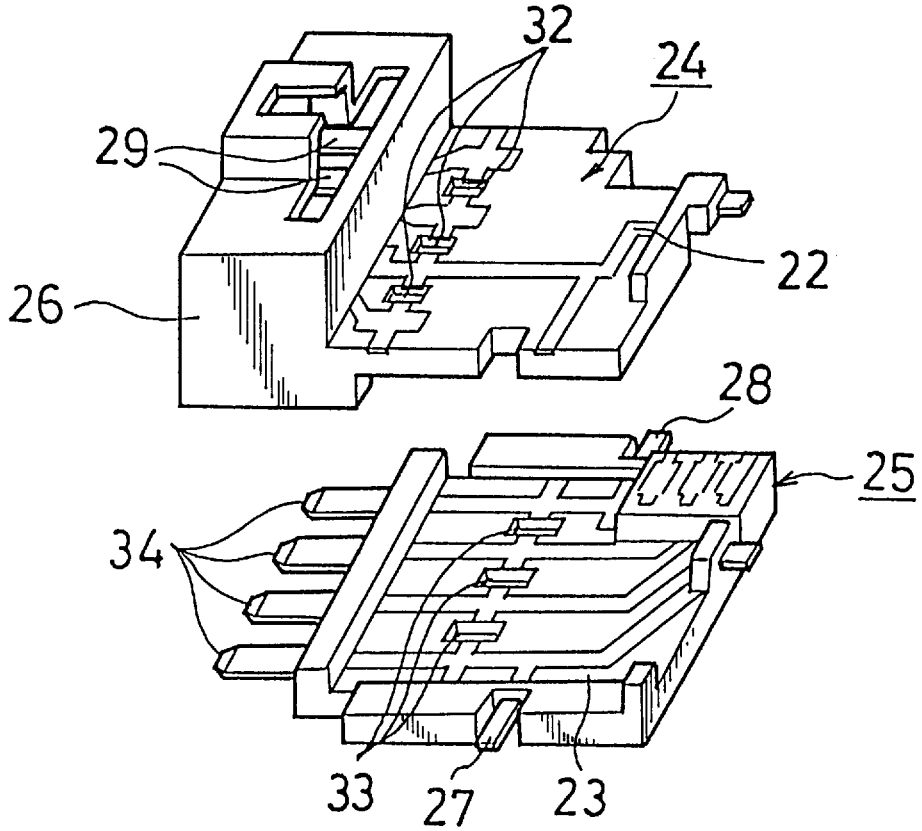
FIG. 7 is an exploded perspective view showing the second stationary member of the second embodiment.
Figure 8:
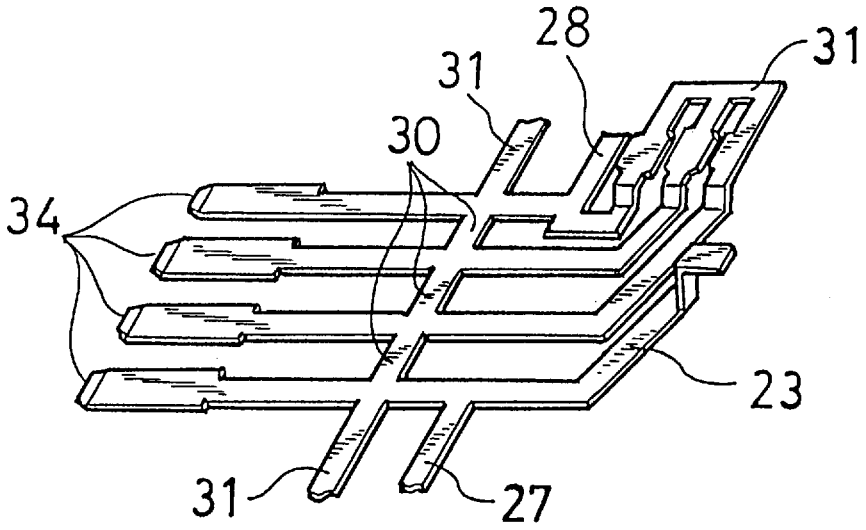
FIG. 8 is a perspective view showing a conductive plate of the second stationary member of the second embodiment before insert-molding.

FIGS. 6 to 8 illustrate a second embodiment of the present invention. FIG. 6 is a perspective view showing a second stationary member of the second embodiment. FIG. 7 is an exploded perspective view showing the second stationary member of the second embodiment. FIG. 8 is a perspective view showing a conductive plate of the second stationary member of the second embodiment before insert-molding.

The second embodiment includes a second stationary member 21 of a stacked structure. In other words, the second stationary member 21 has multiple layers of electrodes, including first and second molded sections 24 and 25. The first and second molded sections 24 and 25 include first and second conductive plates 22 and 23 which are insert-molded in a resin material. The first and second molded sections 24 and 25 are molded from a resin material. The first molded section 24 is in a one piece construction with a connector housing 26.

The second conductive plate 23 insert-molded in the second molded section 25 includes caulking straps 27 and 28, terminals 34, and connecting straps 30 and 31. The caulking straps 27 and 28 are used to firmly connect the second molded section 25 to the first molded section 24. The terminals 34 are located in a connector housing 26 after the second molded section 25 has been assembled to the first molded section 24. The connecting straps 30 are located in alignment with holes 33 formed during the molding of the second molded section 25.

The punch provided on the mold used when molding the second molded section 25 is inserted into the holes 33 in order to cut off the connecting straps 30. The connecting strap 31 is cut off along the outer contour of the second molded section 25. Likewise, the first conductive plate 22 insert-molded in the first molded section 24 also includes terminals 29 and connecting straps. The punch provided on the mold used when molding the first molded section 24 is inserted into the holes 32 in order to cut off the connecting straps. The holes 32 are not in alignment with the holes 33 when assembled, and the holes 32 and 33 are closed by the second and first molded sections 25 and 24, respectively.

Figure 9:
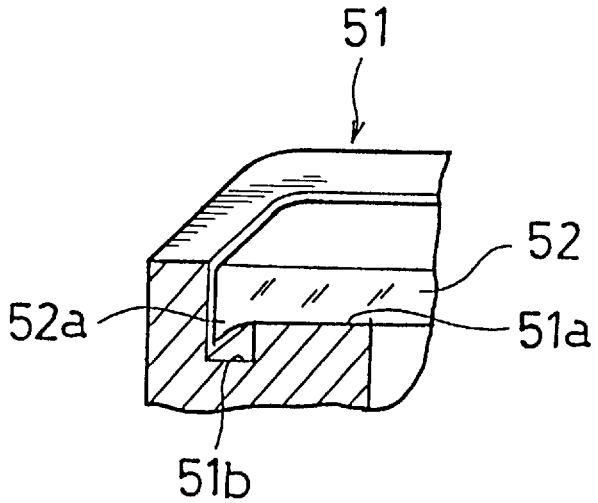
FIG. 9 is a perspective view of a relevant portion where the name plate is bonded to the push button in a third embodiment of the present invention.

FIG. 9 illustrates a third embodiment where the push button 51 has a name plate 52 bonded thereon. The push button 51 is formed with a recess 51*a* and a groove 51*b* formed in the peripheral end of the recess 51*a*. The groove 51*b* accommodates share droops resulting from punching operation when the name plate is made by pressing a plate of, for example, polycarbonate. The width and depth of the groove 51*b* are selected in accordance with the sizes of the share droops. The groove 51*b* eliminates the problem that the share droops 52*a* are developed at the periphery as a result of a punching operation and causes the name plate 52 to rise from the recess 51*a* when the name plate 52 is bonded to the recess. Thus, this groove 51*b* prevents the adhesion from being reduced and light from leaking through the periphery of the name plate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A push lock switch having a lock mechanism for locking a movable member, the movable member moving relative to a stationary member so as to cyclically open and close a switch each time the movable member is pushed, the push lock switch comprising:

a heart cam pivotally mounted to the stationary member; and a lock pin mounted to the movable member and urged toward said heart cam to engage said heart cam;

wherein said movable member is adapted to extend from and retract into the stationary member; and wherein the movable member includes a movable contacting strip having a movable contact and a retainer for retaining said lock pin, said movable contact being in a one piece construction with said retainer.

2. A push lock switch having a lock mechanism for locking a movable member, the movable member moving relative to a stationary member so as to cyclically open and close a switch each time the movable member is pushed the push lock switch comprising:

a heart cam pivotally mounted to the stationary member; and a lock pin mounted to the movable member and urged toward said heart cam to engage said heart cam;

wherein said movable member is adapted to extend from and retract into the stationary member; and wherein the movable member further includes biasing means having a first compression part in the form of a closely wound coil spring and a second compression part in the form of a loosely wound coil spring, said first and second compression parts being in a one piece construction with each other.

3. A push lock switch having a lock mechanism for locking a movable member, the movable member moving relative to a stationary member so as to cyclically open and close a switch each time the movable member is pushed, the push lock switch comprising:

a heart cam pivotally mounted to the stationary member; and a lock pin mounted to the movable member and urged toward said heart cam to engage said heart cam;

wherein said movable member is adapted to extend from and retract into the stationary member; and wherein the stationary member includes a plurality of molded sections each of which is insert-molded from a resin material with a conductive plate therein, at least one of said conductive plates having a caulking strap in a one piece construction with said conductive plate, and the plurality of molded sections being assembled together by caulking using said caulking strap.

* * * * *